US005551253A

United States Patent [19]

Kim

[11] Patent Number: 5,551,253

[45] Date of Patent: Sep. 3, 1996

[54] OIL SEPARATOR FOR AIR CONDITIONER

[75] Inventor: Jong Y. Kim, Suwon, Rep. of Korea

[73] Assignee: Samsung Electronics Co., Ltd., Suwon, Rep. of Korea

[21] Appl. No.: 343,920

[22] Filed: Nov. 17, 1994

[30] Foreign Application Priority Data

Dec. 22, 1993 [KR] Rep. of Korea ..... 1993-29082 U

[51] Int. Cl.[6] ..... F25B 43/02

[52] U.S. Cl. ..... 62/470; 55/326; 55/337; 55/485; 95/268

[58] Field of Search ..... 62/468, 470, 474, 62/84; 55/320, 322, 326, 337, 485; 95/268

[56] References Cited

U.S. PATENT DOCUMENTS 5,113,671 5/1992 Westermeyer ..... 62/470
5,170,640 12/1992 Heitman et al. ..... 62/470

FOREIGN PATENT DOCUMENTS 4-7500 2/1992 Japan .
4-7499 2/1992 Japan .

*Primary Examiner*—John M. Sollecito
*Attorney, Agent, or Firm*—Burns, Doane, Swecker & Mathis, L.L.P.

[57] ABSTRACT

An oil/vapor separator separates lubrication oil from refrigerant vapor in an air conditioning cycle. The separator includes a chamber in which are disposed upper and lower apertured buffer plates sandwiching a filter therebetween. Oil and vapor passing through the buffer plates and the filter exits the lower buffer plate in a swirling path so that centrifugal force displaces oil outwardly against a wall of the chamber, and the oil gravitates downwardly for collection at the bottom of the chamber. The refrigerant vapor is discharged through a vapor outlet pipe positioned centrally in the chamber. An apertured separating plate is situated between the lower buffer plate and the collected oil to isolate the collected oil from the swirling vapor. The vapor outlet pipe extends through the separating plate and is supported thereby.

5 Claims, 5 Drawing Sheets

OIL SEPARATOR FOR AIR CONDITIONER

BACKGROUND OF THE INVENTION

This invention relates to an oil separator for an air conditioner, more particularly to an oil separator for an air conditioner which separates lubricating oil from refrigerant vapor of the refrigerant to transfer the oil stored in the lower part.

A conventional oil separator is shown in FIG. 9. Refrigerant having a misty oil and a superheated vapor flows into a body 101 through the upper part of the body 101 of an oil separator 100. The refrigerant is spread in a loop above a first buffer plate 110 which is mounted in the body 101. The refrigerant passes through wool shaped stainless steel filaments 120 mounted below the first buffer plate 110. The misty oil is congealed into droplets.

The refrigerant having droplets of oil and a superheated vapor passes through a mesh net 140 which is mounted at a lower part of the filaments 120 by a fixing ring 130, whereafter a suspension waste is collected at the net 140. Subsequently, the refrigerant passes through a second buffer plate 150 mounted below the ring 130, and the passed refrigerant is moved in a circular motion because a plurality of guiding holes 151 of the second buffer plate 150 are formed by a burring process and oriented in a circular direction. At this time, since the overheated vapor separated from the refrigerant has less centrifugal force due to relative lighter weight, the vapor flows directly into an outlet pipe 160. Since the droplets of oil have larger centrifugal force due to their relative heavy weight, the oil is spread outwardly to be contained at the inside wall of the body 101. The typical arrangement of that apparatus is described in Japanese Utility Model Publication No. 1992-7499 and No. 1992-7500, respectively.

In those structures, after passing through the second separating plate 150, the refrigerant is swirled by the centrifugal force. Due to the centrifugal force, the oil DO contained in the lower part of the body 101 is also swirled whereby vapor is dissolved in the vibrating oil. Unavoidably, the oil having vapor flows out through the pipe 170. Therefore, it has a problem in that the operation efficiency of the air conditioner is decreased due to a loss of refrigerant vapor. Further, it has another problem in that the outlet pipe for vapor is vibrated by the swirling refrigerant.

SUMMARY OF THE INVENTION

An object of the present invention is to provide an oil separator which can discharge only oil through the pipe for collecting the oil, not refrigerant, thereby preventing the operation efficiency of air conditioner from decreasing.

Another object of the present invention is to provide an oil separator which can firmly support the pipe for discharging the refrigerant and prevents the occurrence of vibration, thereby reducing the noise.

According to the present invention, an oil separator comprises a body; a first buffer plate provided in the body which has a plurality of openings; a second buffer plate supporting stainless wool filaments, a mesh net, and a net fixing ring which are provided under the first buffer plate, providing a plurality of guiding holes for giving centrifugal force to the refrigerant; and a separating plate provided between the second buffer plate and an oil stored in the lower part of the body, for preventing the stored oil from mixing by the swirl of the refrigerant.

Further, the separating plate supports an outlet pipe for the refrigerant which is arranged at the central portion of the body.

Further, the separating plate has a plurality of oil collecting openings.

Furthermore, the oil collecting openings comprise burred openings which face toward the refrigerant discharge direction of the guiding holes.

In this structure, the compressed refrigerant flows through the first buffer plate and is changed into liquid state by the stainless wool filament, and then the refrigerant is filtered by the net. The guiding holes give the centrifugal force to the refrigerant. The refrigerant having oil is separated into vapor and oil. The vapor or the pure refrigerant is directed to the outlet pipe which is mounted at the center of the body. The separated oil runs down to the lower portion of the body along the inner wall of the body. Due to the interception of the separate plate, the oil and the vapor swirled by the centrifugal force can not be transferred to the oil stored in the lower part of the body by the swirling force. Therefore, the collected oil is only discharged through the oil return pipe, thereby increasing the efficiency of the air conditioner. Further, since the outlet pipe for the refrigerant is firmly supported by separating plate, the vibration of the pipe can be prevented which may be induced by the swirl of the refrigerant.

DESCRIPTION OF THE PREFERRED EMBODIMENTS

Figure 1:
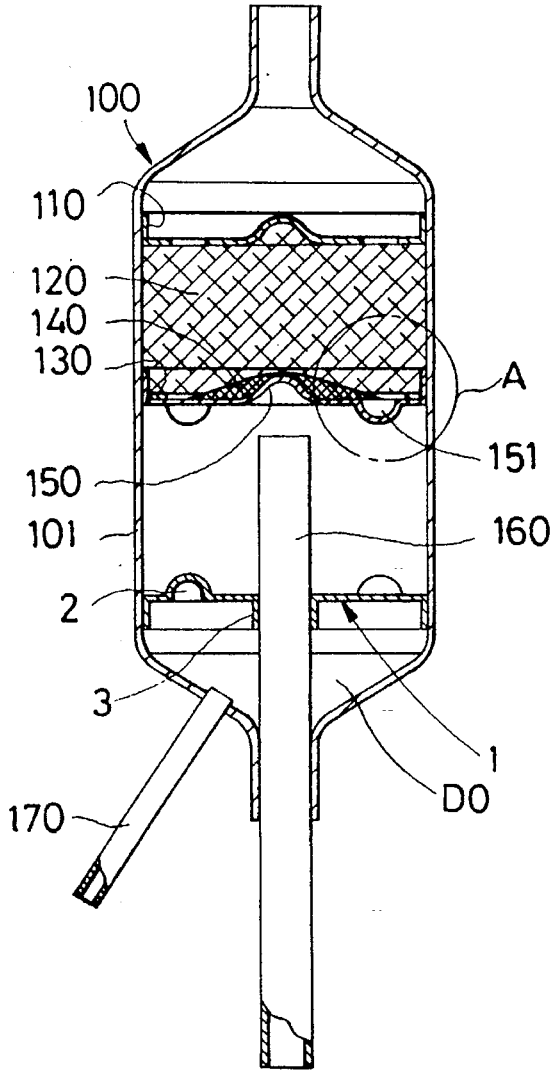
FIG. 1 is a vertical sectional view of an oil separator according to the present invention.
Figure 2:
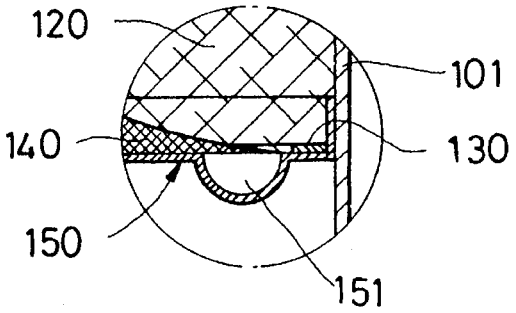
FIG. 2 is an enlarged sectional view of "A" of portion FIG. 1.
Figure 5A:
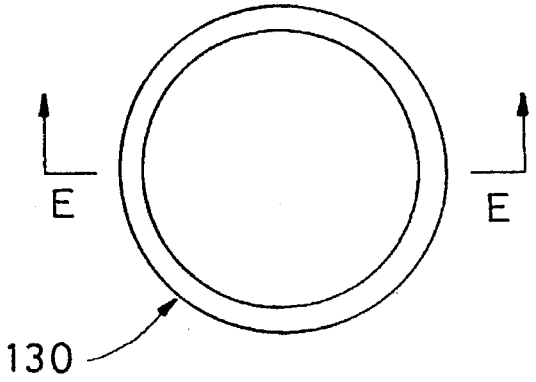
FIG. 5A is a plan view of a net fixing ring.
Figure 5B:
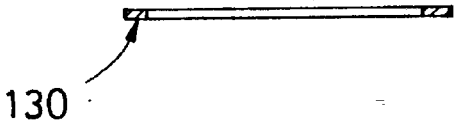
FIG. 5B is a sectional view along line E—E of FIG. 5A.

An oil separator adapting the present invention is shown in FIG. 1. The same components as the prior art are designated by the same numerals. Mounted at an upper end of a chamber formed by a body 101 of the oil separator 100, is a first buffer plate 110. Positioned beneath the first buffer plate 110 are wool shaped stainless steel filaments 120, and under the filaments 120 a mesh net 140 is mounted for filtering the waste. In FIG. 2, the net 140 is shown as mounted to support a second buffer plate 150 and held in place by a fixing ring 130 shown in FIGS. 5A and 5B.

Figure 3A:
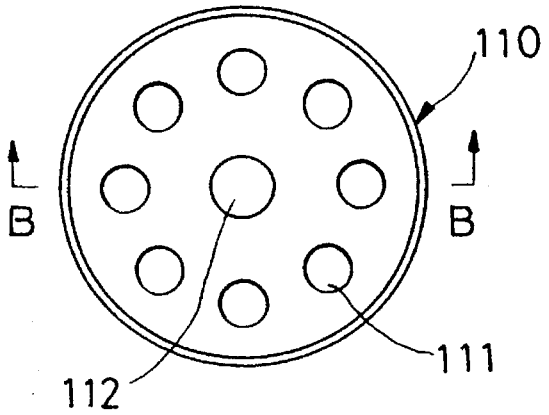
FIG. 3A is a plan view of a first buffer plate.
Figure 3B:
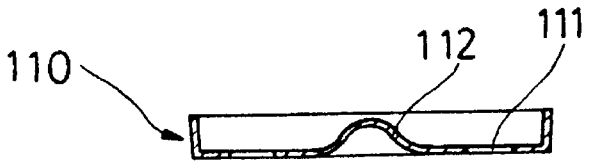
FIG. 3B is a sectional view along line B—B of FIG. 3A.

The first buffer plate 110 comprises a protrusion 112 which is formed at the central portion of the plate 110 shown in FIGS. 3A and 3B. This helps the compressed refrigerant inflowing into the body 101 to spread toward the circumference of the plate 110. Further, a plurality of openings 111 are circumferentially provided between the protrusion 112 and the circumference of the plate 110. The openings 111 guide the spread refrigerant into the section having the filament 120.

Figure 4A:
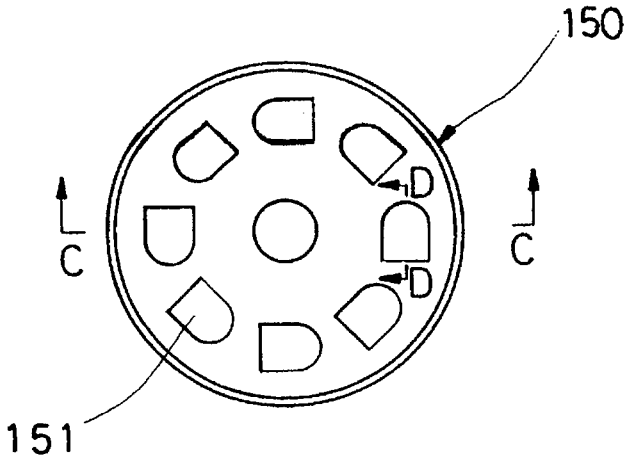
FIG. 4A is a plan view of a second buffer plate.
Figure 4B:
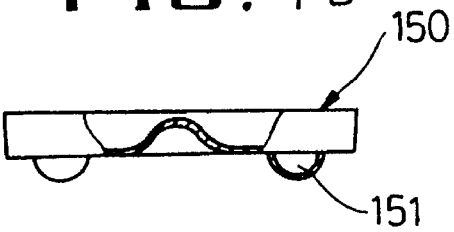
FIG. 4B is a sectional view along line C—C of FIG. 4A.
Figure 4C:
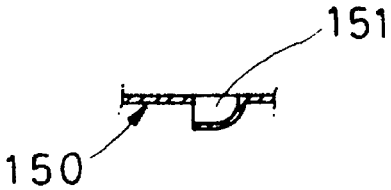
FIG. 4C is a sectional view along line D—D of FIG. 4A.

The second buffer plate 150 (FIGS. 4A, 4B and 4C) is mounted under the net 140. The plate 150 provides a protrusion at a central portion thereof. At the under surface of the plate 150, the second buffer plate 150 has a plurality of guiding holes 151, which are formed by a burring process and oriented circumferentially for applying centrifugal force to the refrigerant. An outlet pipe 160 for the refrigerant and an outlet pipe 170 for the oil are provided at the lower part of the body 101.

Figure 6A:
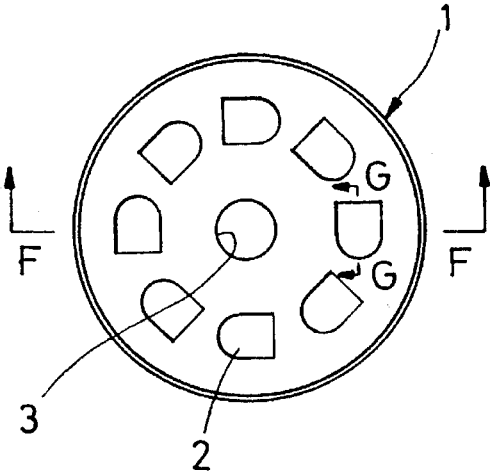
FIG. 6A is a plan view of a separating plate according to the present invention.
Figure 6B:
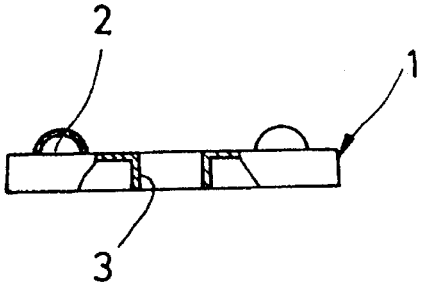
FIG. 6B is a sectional view along line F—F of FIG. 6A.
Figure 6C:
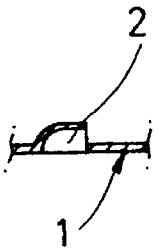
FIG. 6C is a sectional view along line G—G of FIG. 6A.
Figure 7A:
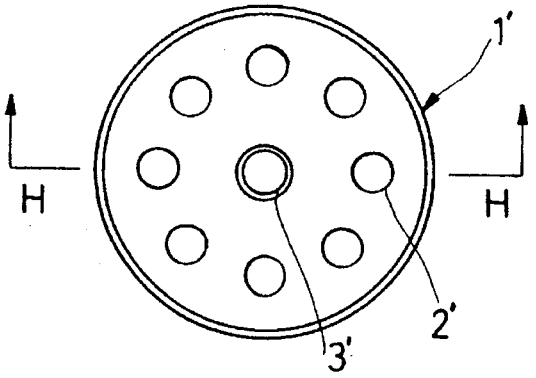
FIG. 7A is a plan view of a separating plate of another embodiment.
Figure 7B:
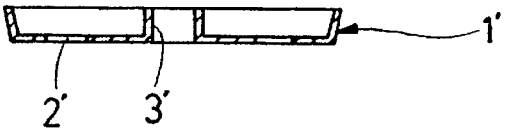
FIG. 7B is a sectional view along line H—H of FIG. 7A.

A separating plate 1 of the present invention is provided between the second buffer plate 150 and the separated oil DO. The separating plate 1, in FIGS. 6A, 6B and 6C, comprises a supporting opening 3 which is formed at the center of the plate 1 for holding the outlet pipe 160 for refrigerant. Offset outwardly from the opening 3 is a plurality of hoppers 2 are circumferentially provided for collecting the separated oil, which hoppers are formed by a burring process. The inlet of each hopper 2 faces in a circumferential direct hole 151 of the second buffer plate. As another embodiment in FIGS. 7A and 7B, the hopper 2 are replaced by collecting holes 2 as formed as through holes in the surface of the separating plate 1.

Figure 8:
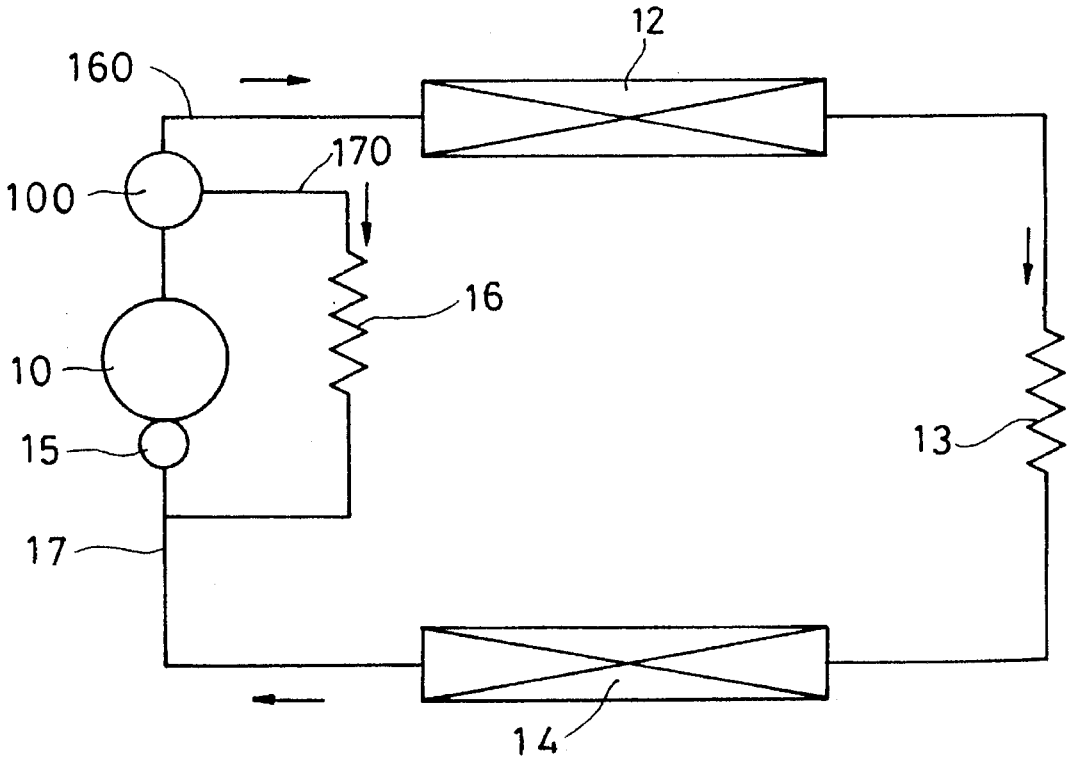
FIG. 8 is a refrigeration cycle containing the present invention.
Figure 9:
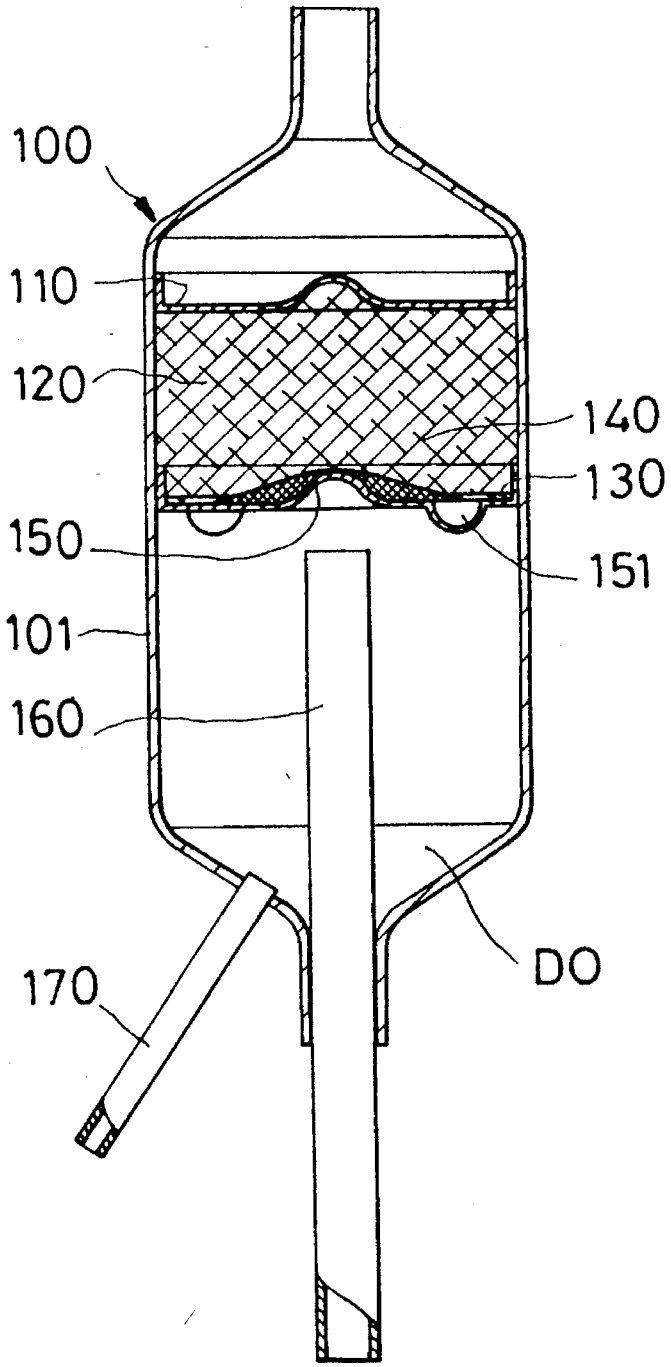
FIG. 9 (PRIOR ART)
FIG. 9 is a vertical sectional view of an oil separator according to a prior art.

Meanwhile, the oil separator 100 which is structured as above is connected between a compressor 10 and a condenser 12 as shown in FIG. 8. The oil return pipe 170 of the oil separator 100 is connected to a pressure reducing apparatus 16. The pressure reducing apparatus 16 is connected to an inlet pipe 17 of the compressor 10. The outlet pipe 160 of the oil separator 100 is connected to the condenser 12. The condenser 12 is connected to the evaporator 14 by another pressure reducing apparatus 13. The evaporator 14 is connected to a liquid separator 15 which is mounted at the inlet of the compressor 10, by an inlet pipe 17.

In the system, the superheated vapor and the misty oil are exhausted from the compressor 10 and flow into the oil separator 100 to be separated into the vapor and the oil. The vapor or refrigerant flows into the condenser 12 to be condensed due to the emitted the heat of the vapor to the outside. The condensed vapor flows into the pressure reducing apparatus 13 and is changed into the low pressure and temperature refrigerant. The refrigerant comes into the evaporator 14 and receives the heat from the outside in order to evaporate itself. The evaporated refrigerant flows into the compressor 10 via the liquid separator 15, thereby completing a cycle. The separated oil of the oil separator 100 comes through the line 170 to the pressure reducing apparatus 16 which controls the volume of the oil.

The oil flows back to the compressor 10 for lubricating the compressor. Since the pressure difference between the pressure of the return pipe 170 and that of the inlet pipe 17 has risen, the pressure reducing apparatus 16 is mounted therebetween for applying a controlled resistance to the discharge of the oil and the vapor to the inlet pipe 17. That is since the return pipe 170 has a relatively high pressure and the inlet pipe 17 has a relatively low pressure, a high pressure difference results. If the pressure reducing apparatus 16 were not installed, the above-described problem could occur because the outlet pipe 170 is directly connected to the inlet pipe 17. The connection or the length of the pressure reducing apparatus, which gives resistance to the flow, is installed to keep the appropriate oil level in the oil separator 100.

The oil separator built as described above is operated as follows. The refrigerant, or the compressed superheated vapor and the misty oil are guided toward the inner wall of the body 101 by the protrusion 112. The guided refrigerant passes through the opening 111 of the first buffer plate 110 to be widely spread and comes into the steel wool filament 120. The misty oil changes into droplets. The refrigerant passes through the metal net 140 and then the waste is filtered. The filtered refrigerant passes through the hopper 151 of the second buffer plate 150. The centrifugal force is applied to the refrigerant to swirl it. Since the oil has a larger centrifugal force, the oil goes toward the inner wall of the body 101, but since the superheated vapor has a lighter mass, the vapor goes directly into the outlet pipe 160.

Further, the oil runs along the inner wall of the body 101 and flows through the opening 2 of the separating plate 1, and is stored at the lower part of the body 101. Due to the separating plate 1, the stored oil DO is in dependent of the swirling process of the refrigerant above the separating plate 1. The stored oil has a stable surface and is discharged to the return pipe 170.

The separating plate 1 according to the invention can prevent the swirling force on the oil stored at the lower part of the body 101. The surface of the oil DO can be statically held and the oil can not flow toward the return pipe 170, thereby increasing the efficiency of the air conditioner. Further, the outlet pipe 160 is held by the supporting hole 3 of the separating plate 1, thereby preventing vibration of the outlet pipe 160 and reducing the noise of the oil separator 100.

What is claimed is:

1. An oil/vapor separator for separating oil from refrigerant vapor, comprising:

a body having a wall forming a chamber, said chamber including an inlet for oil and refrigerant vapor, a first outlet for refrigerant vapor, and a second outlet for oil, said first outlet arranged laterally inwardly from said wall;

a first apertured buffer plate disposed in said chamber below said inlet for distributing oil and refrigerant vapor;

a filtering medium disposed in said chamber below said first buffer plate for filtering said distributed oil and refrigerant vapor;

a second apertured buffer plate disposed in said chamber below said filtering medium and above said first and second outlets for discharging filtered oil and refrigerant vapor in a swirling direction so that the refrigerant vapor is discharged through said first outlet and the oil is displaced outwardly against said wall by centrifugal force and collects at a lower portion of said chamber which communicates with said second outlet; and a separating plate disposed in said chamber below said second buffer plate, said separating plate accommodating the passage of oil downwardly therepast and isolating the oil collected therebelow from the swirling refrigerant vapor;

said second buffer plate including guiding holes through which oil and refrigerant vapor passes, said guiding holes having outlets facing generally circumferentially to produce said swirling of said vapor and oil, said separating plate including holes having inlets facing generally circumferentially for receiving the oil and vapor.

2. The oil/vapor separator according to claim 1, wherein said first outlet comprises a pipe extending through an opening in said body at said lower end of said chamber, said pipe also extending through said separating plate so as to be supported thereby at a location above said opening.

3. The oil/vapor separator according to claim 1, wherein said separating plate includes through-holes through which the oil passes.

4. The oil/vapor separator according to claim 1, wherein said filtering medium comprises stainless wool filaments and a mesh net disposed below said filaments.

5. The oil/vapor separator according to claim 1, wherein said inlet and said first outlet are vertically aligned along an axis extending centrally through said chamber.

* * * * *